United States Patent [19]

Saleil

[11] 3,982,927

[45] Sept. 28, 1976

[54] METHOD OF BLOWING TO OBTAIN A VERY LOW AMOUNT OF CARBON IN CHROME STEELS

[75] Inventor: Jean Saleil, Imphy, France

[73] Assignee: Creusot-Loire, Paris, France

[22] Filed: Jan. 23, 1975

[21] Appl. No.: 543,351

[30] Foreign Application Priority Data

Nov. 13, 1974 France ..... 74.37356

[52] U.S. Cl. ..... 75/60; 75/59

[51] Int. Cl.[2] ..... C21C 5/34

[58] Field of Search ..... 75/59, 60, 51, 52

[56] References Cited

UNITED STATES PATENTS

| | | | |
|---|---|---|---|
| 3,330,645 | 7/1967 | de Moustier | 75/60 |
| 3,706,549 | 12/1972 | Knuppel | 75/60 |
| 3,844,768 | 10/1974 | Leroy | 75/60 |

FOREIGN PATENTS OR APPLICATIONS

| | | | |
|---|---|---|---|
| 1,450,718 | 8/1966 | France | 75/60 |

*Primary Examiner*—Peter D. Rosenberg
*Attorney, Agent, or Firm*—Cameron, Kerkam, Sutton, Stowell & Stowell

[57] ABSTRACT

Chromium-containing steels are decarburised without substantial losses of chromium by blowing simultaneously into the molten steels, below the surface thereof, water vapor and a non-oxidising gas such as hydrogen, nitrogen, argon or helium. A triple feed tuyere is used, with the water vapor in the central or intermediate tube, and the non-oxidizing gas in the other inner tube, and with a protective fluid in the outer tube. The proportions of water vapor and non-oxidizing gas are selected so that the temperature of the steel bath is thereby controlled and also the desired decarburisation occurs without substantial chromium loss.

4 Claims, No Drawings

METHOD OF BLOWING TO OBTAIN A VERY LOW AMOUNT OF CARBON IN CHROME STEELS

The present invention relates to a method of refining chromium-containing steels, particularly but not exclusively stainless steels.

It is known that the decarbonization of steel containing chromium can only be carried out without appreciable loss of chromium, if one or other of the following two methods is used:

a. decarbonization at elevated temperature, b. decarbonization under reduced partial pressure of carbon monoxide. The temperature has to be correspondingly higher, or the partial pressure of carbon monoxide correspondingly lower, as the carbon content of the bath is reduced and as its chromium content is increased. In applying method (b), we have described in French Pat. application Nos. 71-19463, 71-27015 and 71-27016, ways of refining stainless steel baths by means of double- or triple-feed nozzles, and particularly, triple nozzles in which fuel oil is injected through the outer tube, in order to protect the nozzle and the bottom of the converter from thermal wear, and oxygen, water vapour and neutral gases are injected through the two inner tubes of each nozzle, simultaneously or successively, and mixed or separate. In particular, in the French applications, the sequence in refining a stainless steel by means of triple nozzles can advantageously be the following:

refining with pure oxygen in the middle tubes of the triple nozzles, and fuel-oil in the peripheral tubes, to a carbon level above 0.400%; and refining with water vapour in the centre tubes of the nozzles, oxygen in the intermediate tubes, and fuel oil in the peripheral tubes, until the carbon level is at least equal to 0.100%.

The use of water vapour has three advantages:

a. its dissociation supplies oxygen, which makes it possible to continue the refining of the bath;

b. its dissociation supplies hydrogen, which is a diluent for the carbon monoxide and which, for this reason, promotes the decarbonization relative to the scorification of the chromium;

c. the endothermic effect of its dissociation provides a means of influencing the thermal balance of the operation. However, in the production of steel with a very low carbon content, for example less than 0.015%, the dilution effect obtained with water vapour alone can become inadequate for avoiding excessive scorification of the chromium.

It is an object of the present invention to avoid excessive scorification of the chromium, without applying high temperatures, and still producing the very low carbon contents desired.

According to the present invention, there is provided a method of refining a chromium-containing steel which comprises blowing into the steel, below its surface, water vapour and a non-oxidising gas in amounts such that scorification of chromium is restricted and the carbon content is reduced to a low level, and also the temperature of the bath is controlled, wherein the water vapour and non-oxidising gas are each separately and simultaneously blown into the steel through one of the two inner tubes of a nozzle comprising three concentric tubes, and a fluid for protecting the nozzle against wear is blown into the steel through the outer concentric tube.

The non-oxidising gas, may be either a reducing gas such as hydrogen, or a neutral gas such as argon, nitrogen or helium. The fluid for protection against wear may be, for example, fuel oil.

One of the main advantages of the present invention is a superdilution effect on the carbon monoxide, caused both by the non-oxidising gas and by hydrogen formed by the dissociation of the water vapour. The relative proportions of water vapour and non-oxidising gas are varied so as to establish full control of the temperature of the bath, since a non-oxidising gas has a lower cooling effect than the same volume of water vapour. The non-oxidising gas is suitably hydrogen or argon if it is intended to produce chrome-steel with low nitrogen contents, and nitrogen if the grade of steel to be developed must have a certain tolerance for re-nitriding. According to a particular aspect of the invention, the rate of flow of nitrogen can be sufficiently high to enable the development of chrome-steels with a high nitrogen content, e.g. of the order of 0.100 to 0.250%. Injection of nitrogen can thus become an advantage for the highly re-nitrided grades, containing up to 1000 to 2500 ppm of nitrogen.

In order that the invention may be more fully understood, one embodiment thereof will now be described by way of example only.

EXAMPLE

In a 6-ton converter fitted with triple feed nozzles, each comprising three concentric tubes, a chrome-steel bath is refined to a carbon content of the order of 0.145%, by injecting oxygen and water vapour in the inner tubes of each nozzle, and fuel-oil in the outer tube. The temperature of the bath rose to 1690°C, the chromium content was 15.2% and the nitrogen content 320 ppm. Refining was continued, with injection of water vapour for 5 minutes at the rate of 6 kg/min. in the middle tube of each nozzle and 4 kg/min. in the inner tube, while the peripheral tube continued to be supplied with fuel oil. At the end of this phase, the carbon content was 0.045%, the chromium content 14.50%, the temperature 1660°C, and the nitrogen content 290 ppm.

At this instant in the refining process, the method according to the present invention is applied. Refining is continued for 9 minutes in the following manner:

blowing in water vapour in the intermediate tube of each nozzle at the rate of 10 kg/min.;

blowing in nitrogen in the centre tube of each nozzle at the rate of 3.7 $Nm^3$/min.;

blowing in fuel-oil into the peripheral tube of each nozzle at the rate of 0.2 liter per minute.

At the end of this phase, the carbon content of the bath had fallen to 0.009%, the chromium content was 13.3%, the temperature was 1620°C, and the nitrogen content 1090 ppm. The whole of this refining operation was followed by reduction of the chromium oxides in the slag. After addition of a reducing mixture, made up for example of lime and ferrosilicon, the bath and the slag were stirred in the converter for about 8 minutes by blowing in 3.8 $Nm^3$/min. of nitrogen. The final analysis of the steel was:

carbon = 0.013%
chromium = 17.00%
nitrogen = 1950 ppm

The temperature of the bath was 1590°C. It is to be understood that detailed variants and improvements can be conceived and the use of equivalent means visualised, without departing from the scope of the invention. Thus, in the case of triple nozzles, water vapour can be blown in through the centre tube and the non-oxidising gas into the intermediate annular space, while ordinary air is admitted into the peripheral annular space.

I claim:

1. A method of refining a chromium-containing steel which comprises the steps of separately and simultaneously blowing into the steel, below its surface, controlled amounts of water vapour and a non-oxidizing gas to reduce loss of chromium, to reduce the carbon content of the steel to less than 0.015%, and to control the temperature of the bath, the water vapour and non-oxidizing gas each being blown into the steel through one of the two inner tubes of a nozzle comprising three concentric tubes, and a fluid for protecting the nozzle against wear is blown into the steel through the outer concentric tube.

2. A method according to the claim 1, wherein the non-oxidising gas is hydrogen.

3. A method according to the claim 1, wherein the non-oxidising gas is a neutral gas selected from the group consisting of nitrogen, argon and helium.

4. A method according to the claim 3, wherein the non-oxidising gas is nitrogen and its flow rate produces chrome-steels with a nitrogen content on the order of 0.100% to 0.250%.

* * * * *